United States Patent [19]

Muenkel et al.

[11] Patent Number: 4,670,686

[45] Date of Patent: Jun. 2, 1987

[54] CRT INTERNAL MAGNETIC SHIELD CONTACT SPRING

[75] Inventors: Raymond L. Muenkel, Plains; Raymond E. Keller, Clarks Summit, both of Pa.

[73] Assignee: RCA Corporation, Princeton, N.J.

[21] Appl. No.: 857,046

[22] Filed: Apr. 29, 1986

[51] Int. Cl.[4] ..... H01J 29/06

[52] U.S. Cl. ..... 313/402; 313/407; 313/479; 313/482

[58] Field of Search ..... 313/402, 407, 479, 482

[56] References Cited

U.S. PATENT DOCUMENTS

| | | | |
|---|---|---|---|
| 2,906,904 | 9/1959 | Woughter et al. | 313/85 |
| 3,377,493 | 4/1968 | Levin et al. | 313/407 |
| 3,610,990 | 10/1971 | Yamazaki et al. | 313/85 |
| 3,851,435 | 12/1974 | Roberts et al. | 52/754 |
| 4,106,878 | 8/1978 | Jones | 403/28 |
| 4,310,779 | 1/1982 | Penird et al. | 313/407 |
| 4,317,641 | 3/1982 | Sauer | 403/347 |
| 4,433,267 | 2/1984 | Kuryla et al. | 313/402 |
| 4,494,350 | 1/1985 | Sharp | 52/665 |
| 4,525,973 | 7/1985 | Vukmanic et al. | 52/667 |

FOREIGN PATENT DOCUMENTS

| | | | |
|---|---|---|---|
| 60-133637 | of 1985 | Japan | 313/407 |

*Primary Examiner*—Palmer C. DeMeo
*Assistant Examiner*—Sandra L. O'Shea
*Attorney, Agent, or Firm*—E. M. Whitacre; D. H. Irlbeck; T. H. Magee

[57] ABSTRACT

An internal magnetic shield disposed within a CRT has a machine-stamped integral bar member formed parallel to a flat surface thereof such that a narrow underpass is formed between the two ends of the bar member. A flat end of a contact spring having a resilient ramp-shaped tongue projecting therefrom is inserted through the underpass sufficiently to allow the end of the tongue to clear the bar member and spring back to contact the edge of the bar member, thereby preventing removal of the spring.

8 Claims, 7 Drawing Figures

CRT INTERNAL MAGNETIC SHIELD CONTACT SPRING

BACKGROUND OF THE INVENTION

This invention pertains to a contact spring attached to an internal magnetic shield within a cathode-ray tube.

A color cathode-ray tube (CRT) typically has an internal magnetic shield to reduce the influence of magnetic fields on electron beam trajectories as a cathodoluminescent screen of the tube is scanned. The shield is usually made of 0.1 mm thick cold-rolled steel and is fastened to a shadow-mask frame so that the shield and frame are magnetically coupled. The magnetic shield is designed to fit into the funnel and be as close to the funnel wall as possible, but should not touch the funnel to avoid any friction between the shield and a conductive anode coating on the inner surface of the glass funnel.

It has been conventional practice to attach a flexible contact spring to the rear portion of the magnetic shield for effecting an electrical connection between the shield and the conductive coating on the inner surface of the funnel. One means of attaching the contact spring to the magnetic shield is by welding, which tended to erratically produce splatter. The resultant loose particles therefrom are detrimental to tube operation, such as by blocking apertures in the shadow mask or causing shorts and high-voltage arcing.

An improvement in the state of the art was disclosed in U.S. Pat. No. 4,310,779 wherein the contact spring has a wrap-around clip which is facily affixed to a fluting formed in the rear ledge of the magnetic shield. Such a contact spring does not firmly lock onto the magnetic shield, resulting in problems due to "loose" springs. The present invention provides a cooperative locking combination which firmly secures the contact spring to the magnetic shield.

SUMMARY OF THE INVENTION

An internal magnetic shield disposed within a CRT has a machine-stamped integral bar member formed parallel to a flat surface thereof such that a narrow underpass is formed between the two ends of the bar member. A flat end of a contact spring having a resilient ramp-shaped tongue projecting therefrom is inserted through the underpass sufficiently to allow the end of the tongue to clear the bar member and spring back to contact the edge of the bar member, thereby preventing removal of the spring.

DETAILED DESCRIPTION OF THE PREFERRED EMBODIMENT

Figure 1:
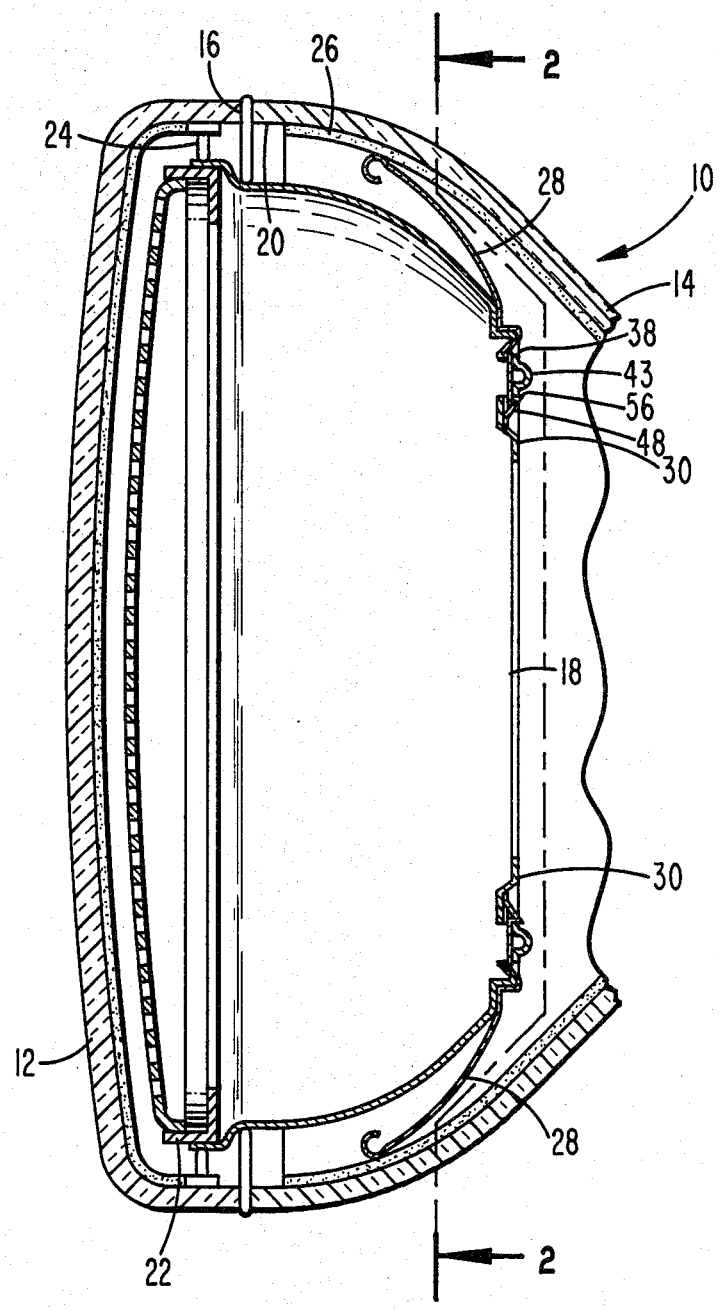
FIG. 1 is a cross-sectional view illustrating a pair of contact springs attached to an internal magnetic shield within a cathode-ray tube.
Figure 2:
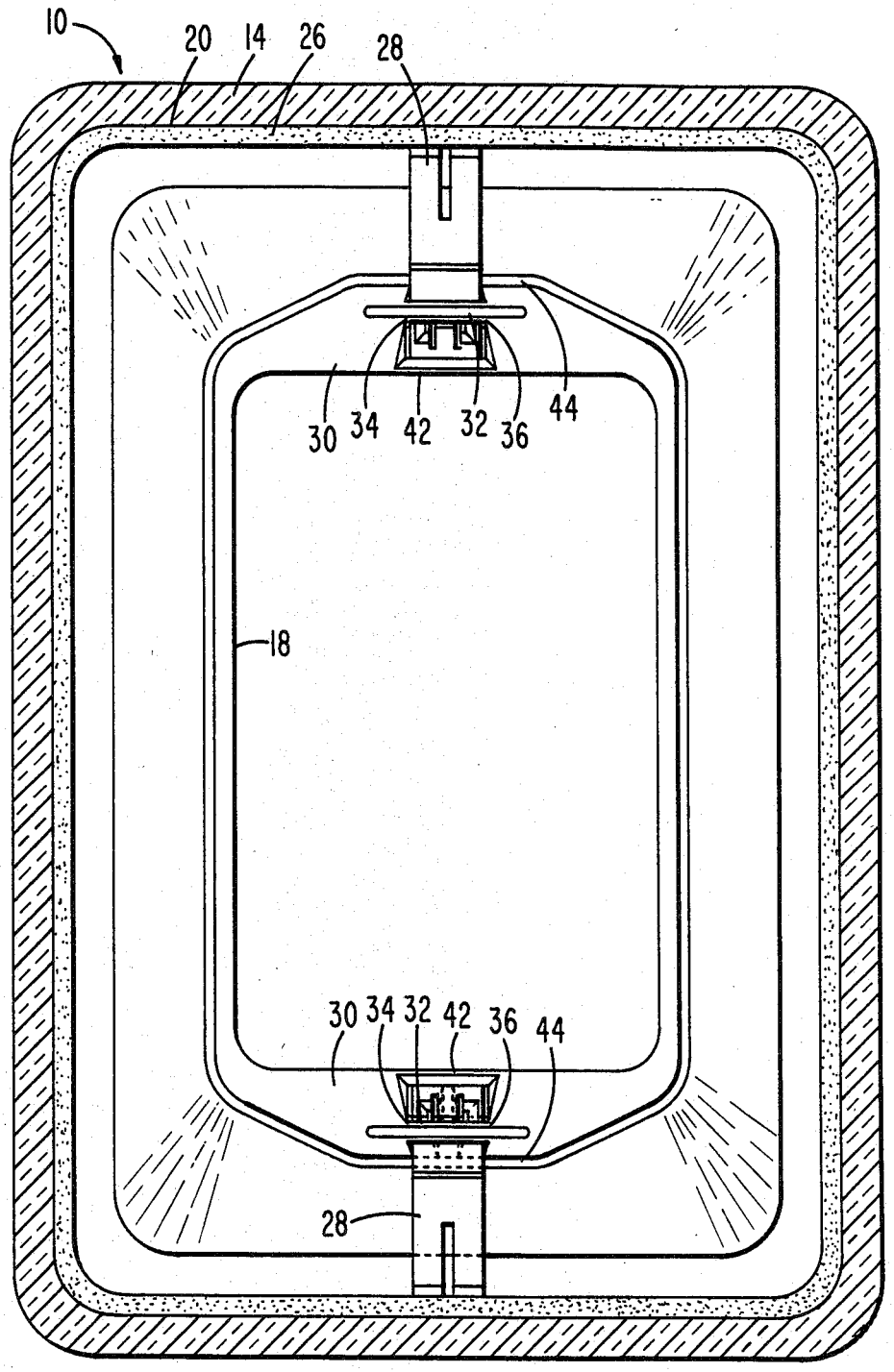
FIG. 2 is a cross-sectional view taken along line 2—2 of FIG. 1.

FIGS. 1 and 2 show a cathode-ray tube 10 having a faceplate panel 12 sealed to a funnel 14 thereof along an edge 16 of the panel 12. The tube 10 has an internal magnetic shield 18 disposed therein proximate an inner surface 20 of the funnel 14. The magnetic shield 18 is fastened to a shadow-mask frame 22 which is supported by mounting studs 24 that extend inwardly from the faceplate panel 12. The inner surface 20 of the funnel 14 has a conductive coating 26 thereon extending along the surface 20 to a predetermined distance from the edge 16. This conductive coating 26 comprises a graphite coating which serves as the positive anode for the tube 10. A pair of contact springs 28 are attached to a substantially flat surface 30 at the rear portion of the internal magnetic shield 18 for effecting an electrical connection between the shield 18 and the conductive coating 26.

Figure 3:
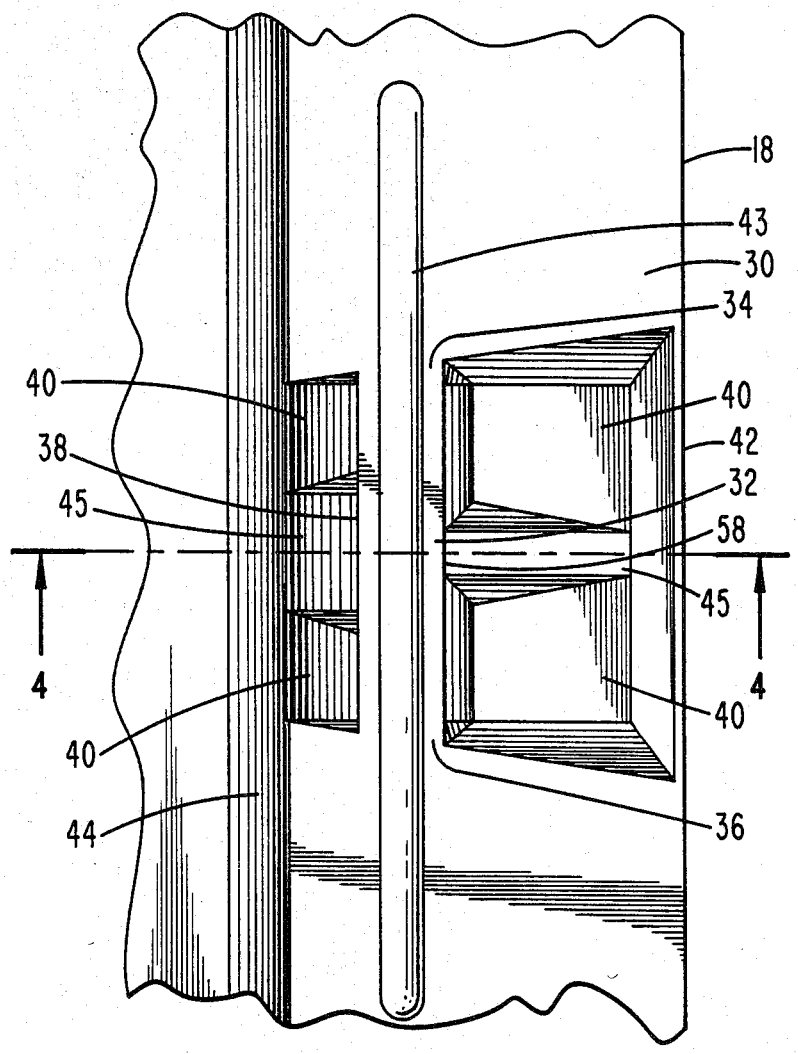
FIG. 3 is a plan view of an enlarged rear portion of the internal magnetic shield without the contact spring attached thereto.
Figure 4:
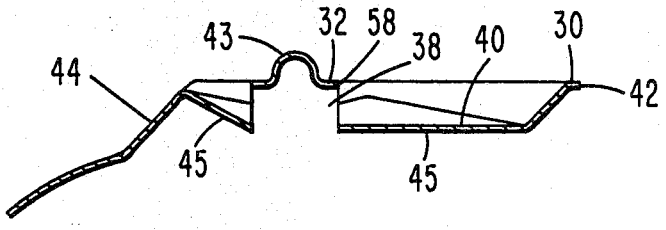
FIG. 4 is a cross-sectional view taken along line 4—4 of FIG. 3.

FIGS. 3 and 4 show a bar member 32 disposed substantially parallel to the flat surface 30. Both ends 34 and 36 of the bar member 32 are integrally connected to the flat surface 30 such that a narrow underpass 38 is formed between the ends 34 and 36. This underpass 38 may be formed by machine stamping the area 40 surrounding the bar 32 away from the plane of the flat surface 30, whereby the bar member 32 is disposed substantially along the plane of the flat surface 30. The machine-stamped area 40 is disposed closely adjacent to an edge 42 at the rear portion of the internal magnetic shield 18, as shown in FIG. 3. The internal magnetic shield 18 is usually made of cold-rolled steel having a thickness of approximately 0.1 millimeter, which is easily machine stamped. The bar member 32 may also have a longitudinal crest 43 machine stamped therein and extending onto the flat surface 30 for structural strength. Similarly, the surrounding area 40 may also have ridgelike crests 45 machine stamped therein to provide structural rigidity and strength.

The internal magnetic shield 18 also has an integral indentation 44 disposed in the flat surface 30 parallel to the bar member 32, as shown in FIGS. 3 and 4. The indentation 44 is disposed in the flat surface 30 at a position to prevent further insertion of the contact spring 28, as explained further below. The indentation 44 may be machine stamped in the internal magnetic shield 18 at the same time the bar member 32 is formed therein.

Figure 5:
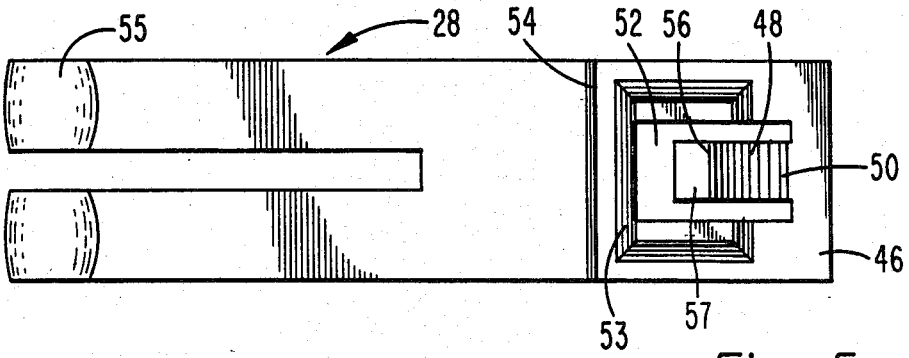
FIG. 5 is a plan view illustrating a contact spring adapted for attachment to the internal magnetic shield.
Figure 6:
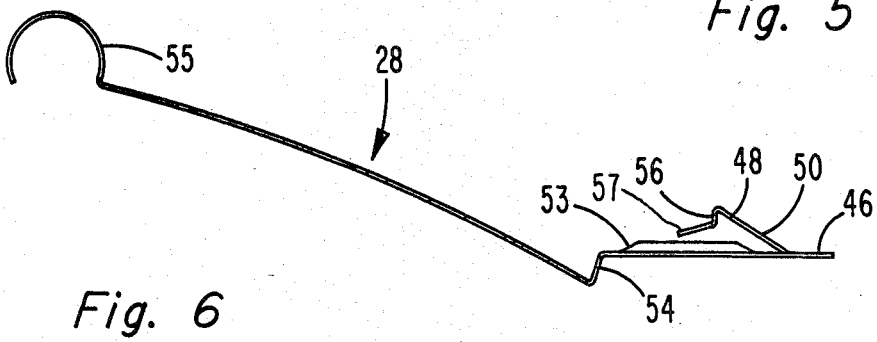
FIG. 6 is a side elevation view of FIG. 5.

FIGS. 5 and 6 show the contact spring 28 having a substantially flat end 46. A resilient ramp-shaped tongue 48, having a ramp section 50, projects from the flat end 46, as illustrated in FIG. 6. An end 56 of the ramp section 50 is substantially orthogonal to the plane of the flat end 46, and has a tab 57 projecting at an obtuse angle therefrom. The tab 57 prevents further removal of the flat end 46 from the underpass 38 should the resilient tongue 48 be depressed after insertion of the contact spring 28, as explained below, by projecting beneath and contacting an edge of the ridgelike crest 45 in the surrounding area 40. The tongue 48 is positioned such that the bar member 32 contacts the ramp section 50 and depresses the tongue 48 towards the flat end 46 as the flat end 46 is being inserted through the underpass 38 (described below). The tongue 48 is integrally connected to the flat end 46 and extends from an aperture 52 in the center of the flat end 46, as illustrated in FIG. 5. The contact spring 28 is made of 0.18 mm thick cold-rolled steel and may be formed by machine stamping. The area of the flat end 46 surrounding the aperture 52 may have a ridgelike crest 53 machine stamped therein to provide structural rigidity and strength.

The contact spring 28 also has integral ridge means 54, positioned parallel to and away from the bar member 32 on the side of the contact spring 28 opposite the tongue 48, for contacting the integral indentation 44 disposed in the flat surface 30 of the internal magnetic shield 18. The ridge means 54 may be machine-stamped in the contact spring 28 at the same time the tongue 48 is formed therein. The end of the spring 28 opposite the flat end 46 has a two-pronged terminal contact element 55 formed to effect contact with the conductive coating 26 disposed on the inner surface 20 of the funnel 14.

Figure 7:
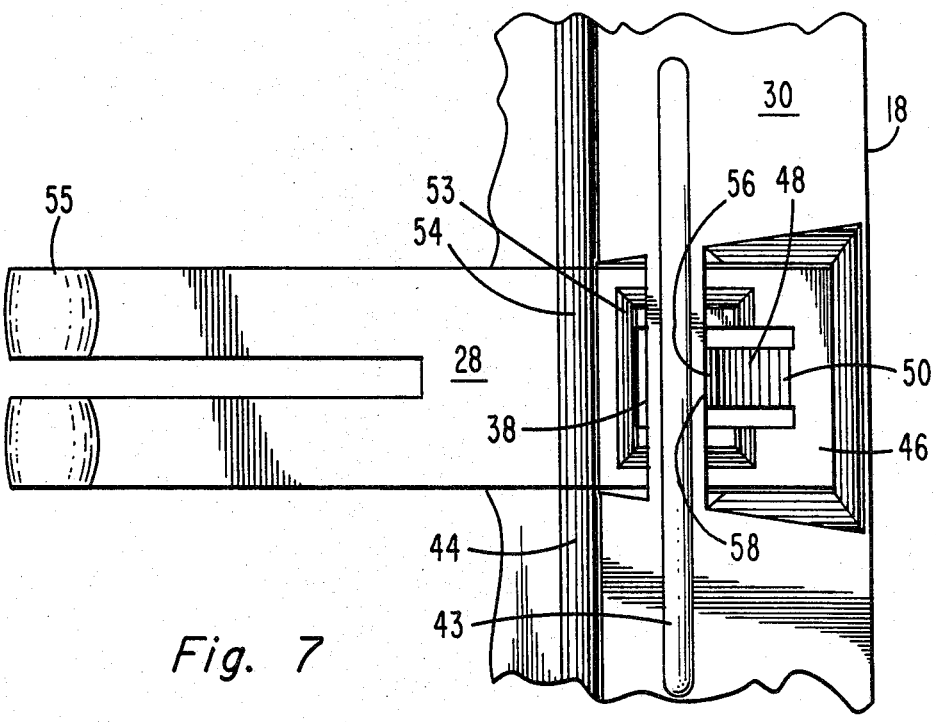
FIG. 7 is a plan view of an enlarged rear portion of the internal magnetic shield with the contact spring attached thereto.

FIG. 7 shows the internal magnetic shield 18 and contact spring 28 locked together. The contact spring 28 is attached to the flat surface 30 of the internal magnetic shield 18 by inserting the flat end 46 of the contact spring 28 through the underpass 38 in the magnetic shield 18. As the flat end 46 is being inserted through the underpass 38, the bar iember 32 contacts the ramp section 50 of the resilient tongue 48 and depresses the tongue 48 towards the flat end 46. The flat end 46 is inserted through the underpass 38 sufficiently to allow the end 56 of the ramp section 50 to clear the bar member 32 and spring back to contact an edge 58 of the bar member 32, as illustrated in FIG. 7. The end 56 of the ramp section 50 locks firmly against the edge 58 of the bar member 32 adjacent the underpass 38, thereby preventing removal of the flat end 46 from the underpass 38 without affirmatively depressing the resilient tongue 48 downward and bending the tab 57 upward above the ridgelike crest 45 in the surrounding area 40.

In order to prevent further insertion of the flat end 46 through the underpass 38 after the tongue 48 has sprung back, the ridge means 54 in the contact spring 28 contacts the indentation 44 in the flat surface 30 and stops any further movement of the spring 28. Thus, the present invention provides a cooperative locking combination which firmly secures the contact spring 28 to the internal magnetic shield 18. No additional clips or welding is necessary; therefore, labor and particle generating processes are eliminated. The present invention also eliminates problems due to "loose" springs.

What is claimed is:

1. In a cathode-ray tube having an internal magnetic shield disposed therein proximate an inner surface of a funnel of said tube wherein a contact spring is attached to a substantially flat surface at the rear portion of said magnetic shield for effecting an electrical connection between said shield and a conductive coating disposed on the inner surface of said funnel, the improvement comprising in cooperative locking combination:

said magnetic shield having a bar member disposed substantially parallel to said flat surface and integrally connected at both ends thereof to said flat surface such that a narrow underpass is formed between said ends; and said contact spring having a substantially flat end with a resilient ramp-shaped tongue projecting therefrom and positioned such that said tongue is depressed towards said flat end as said flat end is being inserted through said underpass, said flat end having been inserted through said underpass sufficiently to allow an end of said ramp-shaped tongue to clear said bar member and spring back to contact an edge of said magnetic shield, thereby preventing removal of said spring.

2. A cathode-ray tube having an internal magnetic shield attached to a contact spring as defined in claim 1 wherein the end of said contact spring has integral ridge means, positioned parallel to and away from said bar member on the side opposite said tongue, for contacting a part of said magnetic shield disposed at a position to prevent further insertion of said flat end through said underpass after said tongue has sprung back.

3. A cathode-ray tube having an internal magnetic shield attached to a contact spring as defined in claim 2 wherein said part of the internal magnetic shield comprises an integral indentation disposed in said flat surface parallel to said bar member.

4. A cathode-ray tube having an internal magnetic shield attached to a contact spring as defined in claim 2 wherein the end of said ramp-shaped tongue is substantially orthogonal to the plane of said flat end, and has a tab projecting at an obtuse angle therefrom toward said integral ridge means.

5. A cathode-ray tube having an internal magnetic shield attached to a contact spring as defined in claim 2 wherein said tongue is integrally connected to said flat end and extends from an aperture in the center of said flat end, having been machine-stamped therefrom.

6. A cathode-ray tube having an internal magnetic shield attached to a contact spring as defined in claim 2 wherein said bar member is disposed substantially along the plane of said flat surface, the area surrounding said bar member having been machine-stamped away from the plane of said flat surface to form said underpass.

7. A cathode-ray tube having an internal magnetic shield attached to a contact spring as defined in claim 6 wherein said machine-stamped area surrounding said bar member is disposed closely adjacent to an edge at the rear portion of said internal magnetic shield.

8. A cathode-ray tube having an internal magnetic shield attached to a contact spring as defined in claim 7 wherein said contact spring and said internal magnetic shield comprise cold-rolled steel having thicknesses of approximately 0.18 and 0.1 millimeters, respectively.

* * * * *